US011091978B2

(12) United States Patent
Hijles

(10) Patent No.: US 11,091,978 B2
(45) Date of Patent: Aug. 17, 2021

(54) STAGE CEMENTING AN ANNULUS OF A WELLBORE

(71) Applicant: Saudi Arabian Oil Company, Dhahran (SA)

(72) Inventor: Ali A Hijles, Algatif (SA)

(73) Assignee: Saudi Arabian Oil Company, Dhahran (SA)

( * ) Notice: Subject to any disclaimer, the term of this patent is extended or adjusted under 35 U.S.C. 154(b) by 56 days.

(21) Appl. No.: 16/391,039

(22) Filed: Apr. 22, 2019

(65) Prior Publication Data

US 2020/0332624 A1 Oct. 22, 2020

(51) Int. Cl.
*E21B 33/14* (2006.01)
*E21B 34/14* (2006.01)
*E21B 33/16* (2006.01)

(52) U.S. Cl.
CPC ..... *E21B 33/146* (2013.01); *E21B 33/16* (2013.01); *E21B 34/14* (2013.01)

(58) Field of Classification Search
CPC ..... E21B 34/14; E21B 33/146; E21B 33/16; E21B 33/14; E21B 34/142; E21B 33/165; E21B 33/167
See application file for complete search history.

(56) References Cited

U.S. PATENT DOCUMENTS 3,768,556 A 10/1973 Baker
5,277,253 A 1/1994 Giroux et al.
5,279,370 A * 1/1994 Brandell ..... E21B 33/128 166/386
8,342,243 B2 1/2013 Esmail
8,783,351 B2 * 7/2014 Lee ..... E21B 33/146 166/285
9,038,720 B2 * 5/2015 Esmail ..... E21B 33/146 166/285
2012/0325475 A1 12/2012 Lee et al.
2015/0021026 A1 1/2015 Giroux
2015/0184489 A1 7/2015 Resweber
2017/0218710 A1 8/2017 Zhou
2018/0266208 A1 9/2018 De Oliveira et al.

FOREIGN PATENT DOCUMENTS

WO WO 2018017104 1/2018

OTHER PUBLICATIONS

PCT International Search Report and Written Opinion issued in International Appl. No. PCT/US2020/029223 dated Jul. 24, 2020, 13 pages.

* cited by examiner

*Primary Examiner* — Catherine Loikith
(74) *Attorney, Agent, or Firm* — Fish & Richardson P.C.

(57) ABSTRACT

A stage cementing tool includes a housing configured to couple to a casing and having a central bore therethrough, a first plurality of ports arranged on a radial surface of the housing and configured to fluidly connect the central bore and an annulus of a wellbore, a second plurality of ports arranged on the radial surface of the housing uphole of the first plurality of ports and configured to fluidly connect the central bore and the annulus of the wellbore, an expandable element coupled to the housing between the first plurality of ports and the second plurality of ports, and a sleeve. The sleeve is moveable from a first position on the housing to a second position on the housing to fluidly disconnect the central bore and the annulus through the first plurality of ports and fluidly connect the central bore and the annulus through the second plurality of ports.

9 Claims, 6 Drawing Sheets

STAGE CEMENTING AN ANNULUS OF A WELLBORE

TECHNICAL FIELD

The present disclosure relates to apparatus, systems, and methods for stage cementing and, more particularly, stage cementing of a casing in a lost circulation zone of a wellbore.

BACKGROUND

Stage-cementing tools, or differential valve (DV) tools, are used to cement casing sections behind the same casing string, or to cement a critical long section in multiple stages. Stage cementing may reduce mud contamination and lessens the possibility of high filtrate lost or formation breakdown caused by high hydrostatic pressures, which is often a cause for lost circulation. In a multi-stage cementing process, a first (or bottom) cement stage is pumped through a cementing tool to the end of the casing and up an annulus to a calculated-fill volume (for example, height) and a second (or top) cement stage is pumped through the cementing tool and displaced uphole of the tool. Whenever a casing is placed in a portion of the wellbore in which lost circulation is likely to occur (for example, a lost circulation zone), proper stage cementing is critical. However, stage cementing tools typically fail to properly cement the region of the annulus downhole of the stage cementing tool and uphole of the lost circulation zone, resulting in an increased risk of corrosion of the exposed casing and reduced mechanical support of the casing.

SUMMARY

In an example implementation, a stage cementing tool includes a housing configured to couple to a casing and having a central bore therethrough, a first plurality of ports arranged on a radial surface of the housing and configured to fluidly connect the central bore and an annulus of a wellbore, a second plurality of ports arranged on the radial surface of the housing uphole of the first plurality of ports and configured to fluidly connect the central bore and the annulus of the wellbore, an expandable element coupled to the housing between the first plurality of ports and the second plurality of ports, and a sleeve. The sleeve is moveable from a first position on the housing to a second position on the housing to fluidly disconnect the central bore and the annulus through the first plurality of ports and fluidly connect the central bore and the annulus through the second plurality of ports.

An aspect combinable with the example implementation further includes a seal that fluidly seals the first plurality of ports and is configured to fail at a threshold fluid pressure.

In another aspect combinable with any of the previous aspects, the seal includes a rupture disc.

In another aspect combinable with any of the previous aspects, the sleeve is moveable in an axial direction on the housing from the first position on the housing to the second position on the housing.

In another aspect combinable with any of the previous aspects, the sleeve is rotatable within the housing between the first position on the housing and the second position on the housing.

In another aspect combinable with any of the previous aspects, the expandable element includes a packer.

In another aspect combinable with any of the previous aspects, the first plurality of ports are positionable to connect the central bore and a portion of the annulus between the stage cementing tool and a top of a lost circulation zone of the wellbore.

In another aspect combinable with any of the previous aspects, the second plurality of ports are positionable to connect the central bore and a portion of the annulus uphole of the stage cementing tool.

In another example implementation, a stage cementing system includes a casing disposed within a wellbore, the casing including a central bore therethrough configured to receive a pressurized fluid at a pressure greater than a threshold fluid pressure, a wiper plug configured to be communicated through the central bore of the casing, a stage cementing tool configured to couple within the casing. The stage cementing tool includes a housing that includes a central bore therethrough, a first plurality of ports arranged on a radial surface of the housing and configured to connect the central bore of the housing and an annulus of the wellbore, a second plurality of ports arranged on the radial surface of the housing uphole of the first plurality of ports and configured to fluidly connect the central bore of the housing and the annulus of the wellbore, an expandable element coupled to the housing between the first plurality of ports and the second plurality of ports, and a sleeve. The sleeve is moveable from a first position on the housing to a second position on the housing to fluidly disconnect the central bore and the annulus through the first plurality of ports and fluidly connect the central bore and the annulus through the second plurality of ports.

In an aspect combinable with the example implementation, the stage cementing tool further includes a seal that fluidly seals the first plurality of ports and is configured to fail at a threshold fluid pressure.

In another aspect combinable with any of the previous aspects, the seal includes a rupture disc.

In another aspect combinable with any of the previous aspects, the wiper plug is configured to move the sleeve from the first position on the housing to the second position on the housing.

In another aspect combinable with any of the previous aspects, the sleeve is moveable in an axial direction on the housing from the first position on the housing to the second position on the housing.

In another aspect combinable with any of the previous aspects, the sleeve is rotatable within the housing between the first position on the housing and the second position on the housing.

In another aspect combinable with any of the previous aspects, the first plurality of ports are positionable to connect the central bore of the housing and a portion of the annulus between the bottom of the stage cementing tool and the top of a lost circulation zone of the wellbore.

In another aspect combinable with any of the previous aspects, the second plurality of ports are positionable to connect the central bore of the housing and a portion of the annulus uphole of the stage cementing tool.

Another aspect combinable with any of the previous aspects further includes a plurality of distal ports arranged on a radial surface of the casing downhole from the stage cementing tool configured to fluidly connect the central bore of the casing and the annulus of the wellbore.

In another aspect combinable with any of the previous aspects, the plurality of distal ports are positionable to connect the central bore of the casing and a portion of the annulus downhole of a lost circulation zone of the wellbore.

In another example implementation, a stage cementing method includes positioning a casing that includes a stage cementing tool in a wellbore, expanding an expandable element coupled to a housing of the stage cementing tool between a first plurality of ports arranged on a radial surface of a housing of the stage cementing tool and a second plurality of ports arranged on the radial surface of the housing uphole of the first plurality of ports, opening the first plurality of ports to connect the central bore of the stage cementing tool to an annulus of the wellbore, circulating a first flow of cement through the first plurality of ports to a first portion of an annulus of the wellbore located adjacent the radial surface of the casing between the bottom of the stage cementing tool and the top of a lost circulation zone of the wellbore, moving a sleeve of the stage cementing tool from a first position on a housing of the stage cementing tool to a second position on the housing of the stage cementing tool to fluidly disconnect the central bore of the stage cementing tool and the annulus through the first plurality of ports and to fluidly connect the central bore of the stage cementing tool and the annulus through the second plurality of ports, and circulating a second flow of cement through the second plurality of ports to a second portion of the annulus of the wellbore adjacent the radial surface uphole of the stage cementing tool.

In an aspect combinable with the example implementation, positioning the casing includes lowering the casing in the wellbore to position the first plurality of ports uphole of the lost circulation zone of the wellbore.

In another aspect combinable with any of the previous aspects, expanding the expandable element includes receiving a fluid have a first fluid pressure greater than a first threshold pressure from the central bore of the casing.

In another aspect combinable with any of the previous aspects, opening the first plurality of ports includes receiving a fluid having a second fluid pressure greater than a second threshold pressure from the central bore of the casing.

In another aspect combinable with any of the previous aspects, the second fluid pressure ruptures a seal of the stage cementing tool that fluidly seals the first plurality of ports.

Another aspect combinable with any of the previous aspects further includes communicating a wiper plug through the central bore of the casing, and based on communicating the wiper plug through the central bore of the casing, moving the sleeve of the stage cementing tool from the first position on the housing of the stage cementing tool to the second position on the housing of the stage cementing tool.

In another aspect combinable with any of the previous aspects, moving the sleeve of the stage cementing from the first position on the housing of the stage cementing tool to the second position on the housing of the stage cementing tool includes shifting the sleeve axially within the housing.

In another aspect combinable with any of the previous aspects, moving the sleeve of the stage cementing from the first position on the housing of the stage cementing tool to the second position on the housing of the stage cementing tool includes rotating the sleeve within the housing.

Another aspect combinable with any of the previous aspects further includes circulating a preliminary flow of cement through the central bore of the casing and through a plurality of distal ports downhole from the stage cementing tool to a portion of the annulus below a loss circulation zone, and communicating a wiper plug through the central bore of the wellbore to a distal portion of the casing, and the wiper plug couples to a float collar to disconnect the central bore of the casing and the annulus through the distal ports.

The details of one or more embodiments are set forth in the accompanying drawings and the description. Other features, objects, and advantages will be apparent from the description and drawings, and from the claims.

DETAILED DESCRIPTION

The present disclosure describes a stage cementing tool and system for a cementing process to set a casing into a wellbore. In some aspects, the stage cementing tool and system provide for stage cementing of a portion of the annulus located downhole of the stage cementing tool and uphole of a lost circulation zone of the wellbore.

Figure 1:
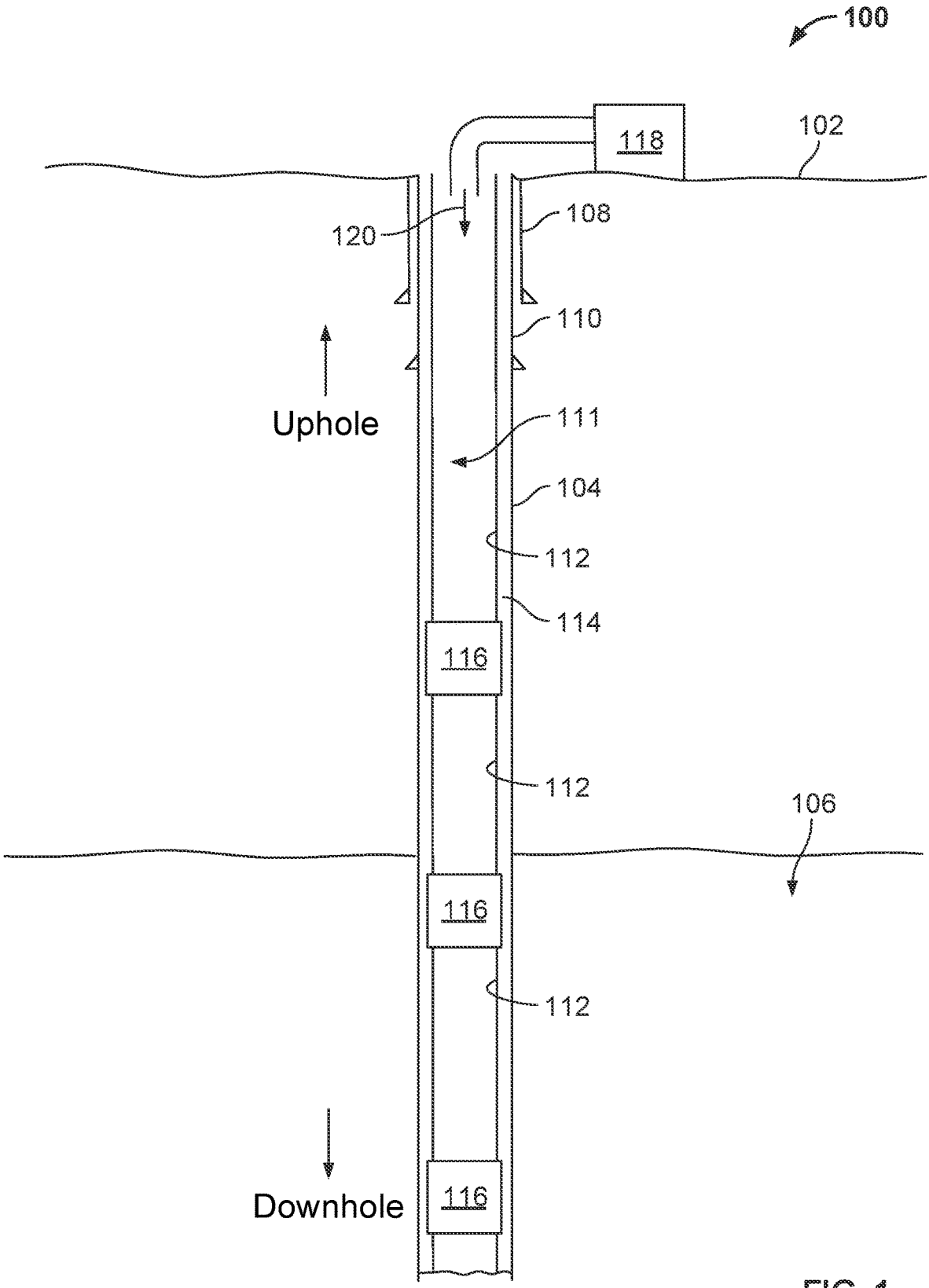
FIG. 1 is a schematic illustration of an example implementation of a stage cementing system according to the present disclosure.

FIG. 1 is a schematic illustration of an example implementation of a stage cementing system 100. As shown in FIG. 1, a wellbore 104 is formed from a terranean surface 102 to one or more subterranean zones 106. Although shown as a wellbore 104 that extends from land, the wellbore 104 may be formed under a body of water rather than the terranean surface 102. For instance, in some embodiments, the terranean surface 102 may be below an ocean, gulf, sea, or any other body of water under which hydrocarbon-bearing, or water-bearing, formations may be found. In short, reference to the terranean surface 102 includes both land and underwater surfaces and contemplates forming or developing one or more wellbores 104 from either or both locations.

Generally, the wellbore 104 may be formed by any appropriate assembly or drilling rig used to form wellbores or boreholes in the Earth. A drilling assembly may use traditional techniques to form such wellbores or may use nontraditional or novel techniques. In some embodiments, a drilling assembly may use rotary drilling equipment to form such wellbores. Although shown as a substantially vertical wellbore (for example, accounting for drilling imperfections), the wellbore 104, in alternative aspects, may be directional, horizontal, curved, multi-lateral, or other form other than merely vertical.

Once the wellbore 104 is formed (or in some cases during portions of forming the wellbore 104), one or more tubular casings may be installed in the wellbore 104. As illustrated, the wellbore 104 includes a conductor casing 108, which extends from the terranean surface 102 shortly into the Earth. A portion of the wellbore portion 104 enclosed by the conductor casing 108 may be a large diameter borehole.

Downhole of the conductor casing 108 may be the surface casing 110. The surface casing 110 may enclose a slightly smaller borehole and protect the wellbore 104 from intrusion of, for example, freshwater aquifers located near the terranean surface 102. Downhole of the surface casing 110 (or, in some aspects, an additional intermediate casing), is a production casing 111, that is formed of production casing joints 112 (or casing joints 112). Generally, each casing joint 112 is a tubular that may be coupled (for example, threadingly) to another casing joint 112, or as shown in FIG. 1, a stage cementing tool 116 according to the present disclosure. The production casing 111, generally, may be installed adjacent or across a hydrocarbon bearing reservoir, for example, subterranean zone 106. Completion components, such as perforating, hydraulic fracturing, acidizing, artificial lift components, are subsequently installed within the production casing 111 to produce hydrocarbons from the subterranean zone 106 to the terranean surface 102.

In the illustrated implementation, the production casing 111 (and other casings shown herein) may be installed, or set, in the wellbore 104 with cement (or other hardenable substance capable of setting the casing 111 in the wellbore 104). For example, cement 120 may be circulated from surface cementing equipment 118 into the production casing 111 from the terranean surface, through one or more of the stage cementing tools 116 installed in the production casing 111 (or other casings, such as an intermediate casing), and into an annulus 114 between the casing 111 and the wellbore 104. Once the cement 120 fills the annulus 114 adjacent the production casing 111 and hardens, the production casing 111 (and other casings) may be set into the wellbore 104, thereby allowing completion operations to commence.

The schematic representation of the surface cementing equipment 118 includes, for example, one or more pumps, valves, and conduits that are fluidly coupled to a source of cement, such as cement mixed or stored in one or more tanks of the system 118.

The example system 100 may perform a cementing operation to set the production casing 111 (or other casings) into the wellbore 104 in two or more stages. For example, each "stage" may include flowing the cement 120 into the casing 111, through at least one of the stage cementing tools 116, and into the annulus 114 to fill a portion of the annulus 114 (less than the full annulus 114) with cement 120. For example, a first stage of the cementing operation may include circulating a portion of cement 120 through a downhole-most stage cementing tool 116 (for example, the tool 116 closest downhole to the true vertical depth of the wellbore 104) and filling the annulus 114 between the downhole-most stage cementing tool 116 and the next most-downhole stage cementing tool 116. A second stage of the cementing operation may include circulating another portion of cement 120 through the next most-downhole cementing tool 116 and filling the annulus 114 between the next-most downhole stage cementing tool 116 and the stage cementing tool 116 that is uphole of the next-most downhole stage cementing tool 116. Additional stages can be completed to fill (for example, all or substantially) the annulus 114 with cement 120.

In some implementations, the first stage of cementing may include a first phase and a second phase. The first phase of the first stage of cementing may include circulating a portion of cement 120 through ports located on the radial surface of the casing 111 downhole of a lost circulation zone of the wellbore 104 to a portion of the annulus 114 between the ports located on the radial surface of the casing 111 downhole of a lost circulation zone and the bottom of the lost circulation zone. A second phase of the first stage of the cementing operation may include circulating another portion of cement 120 through a first set of ports arranged on a radial surface of a stage cementing tool 116 uphole of the lost circulation zone and filling the annulus 114 between the first set of ports of the stage cementing tool 116 and the top of the lost circulation zone of the wellbore 104. The second stage of the cementing operation may include circulating another portion of cement 120 through a second set of ports arranged on the radial surface the stage cementing tool 116 uphole of the first set of ports and filling the annulus 114 uphole of the second set of ports of the stage cementing tool 116. In some examples, an expandable seal is disposed in a central bore of the stage cementing tool 116 and is configured to isolate the first set of ports from the second set of ports following completion of the first phase of the first stage of the cementing operation.

Figure 2A:
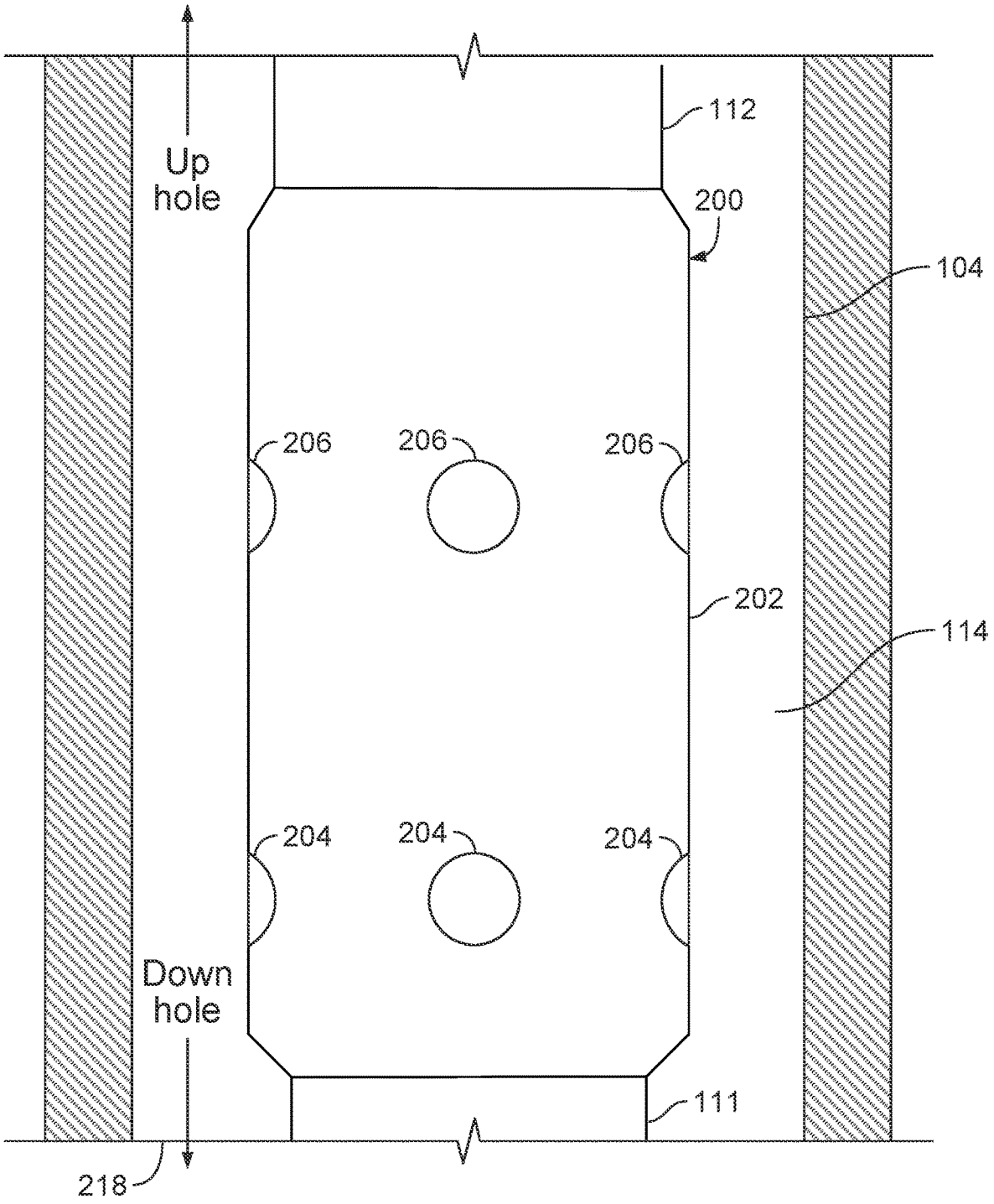
FIG. 2A is a schematic illustration of an example implementation of a stage cementing tool for a stage cementing system according to the present disclosure.
Figure 2B:
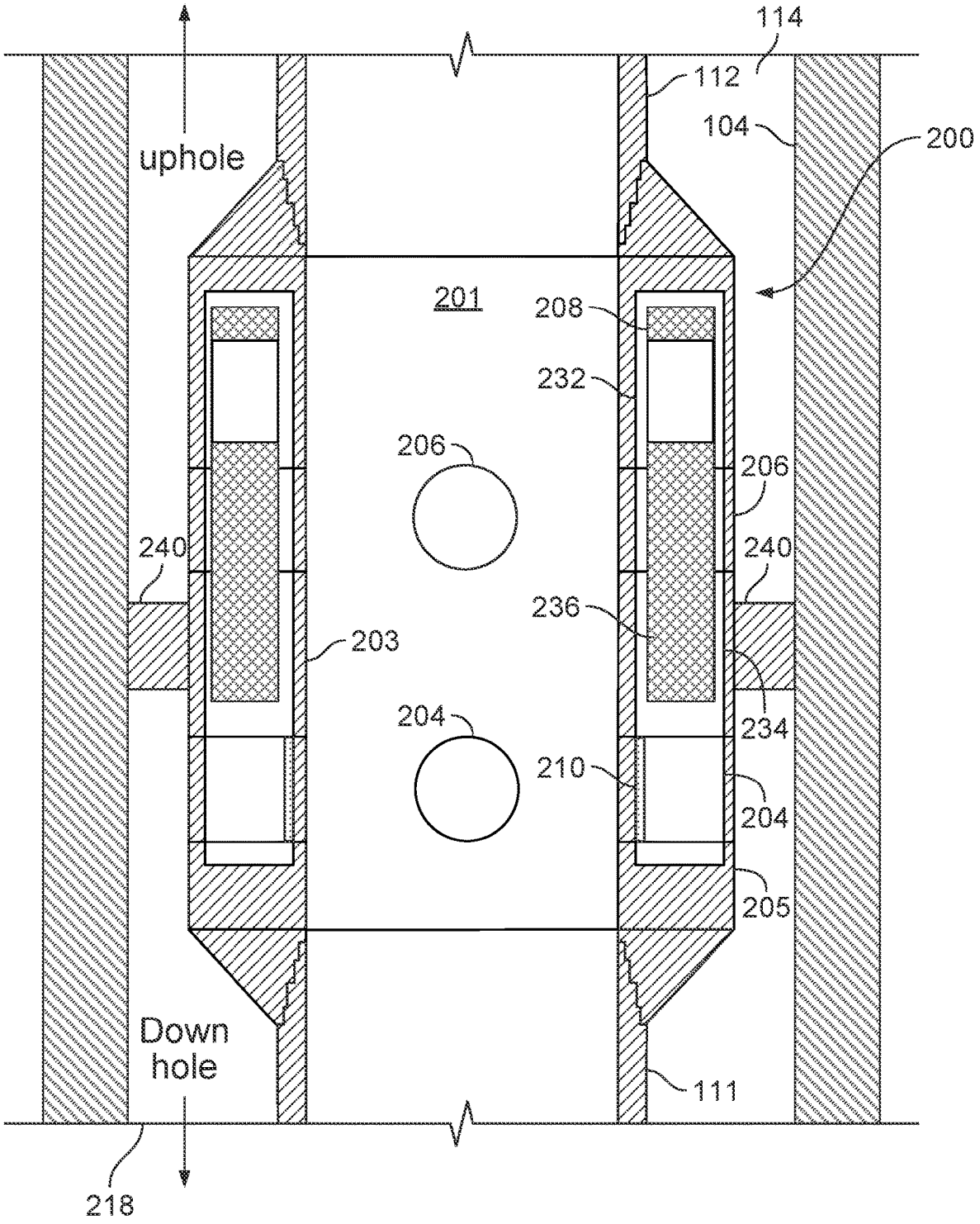
FIG. 2B is a schematic cross-sectional view of the example implementation of the stage cementing tool in a closed position according to the present disclosure.
Figure 2C:
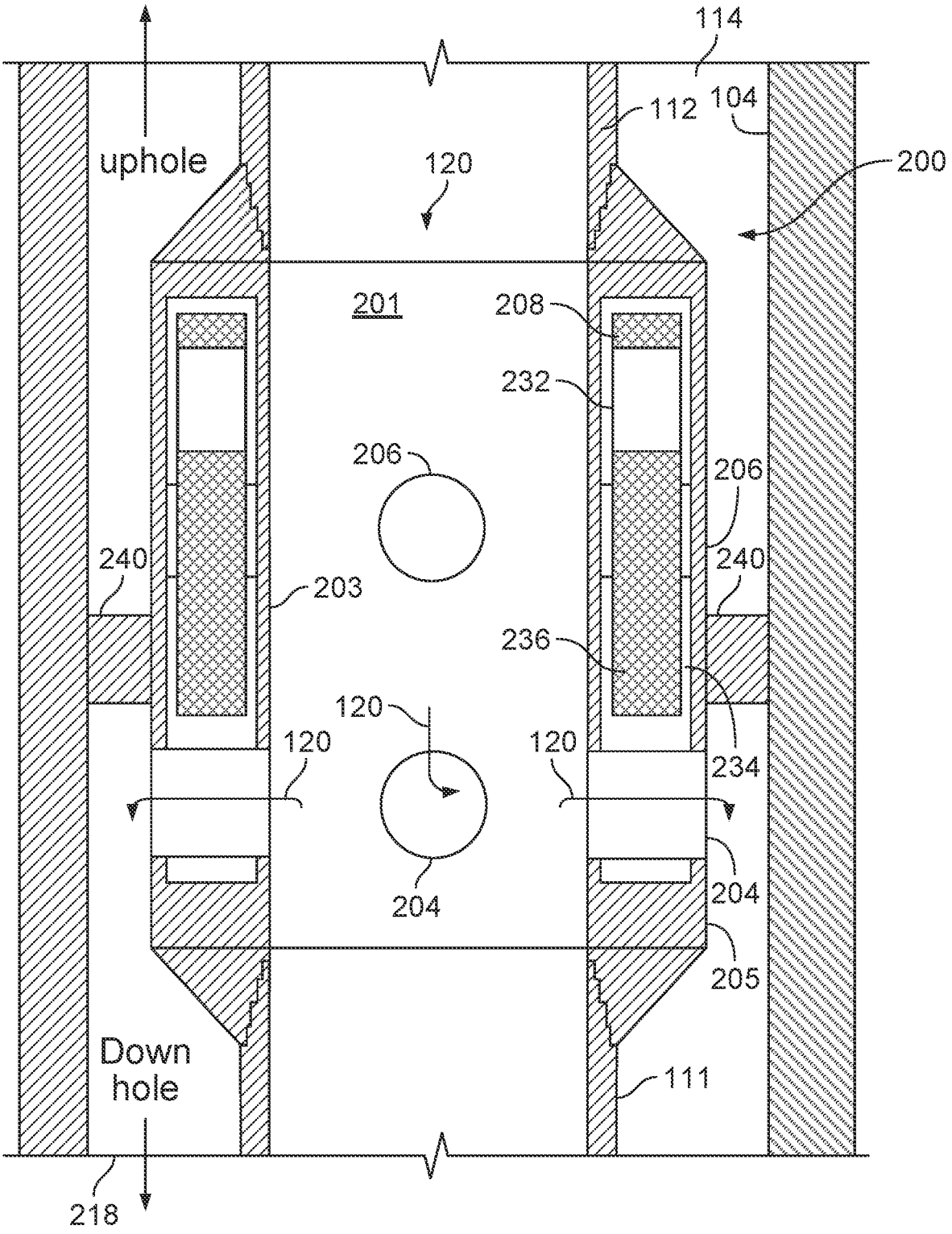
FIG. 2C is a schematic cross-sectional view of the example implementation of the stage cementing tool in a first open position according to the present disclosure.
Figure 2D:
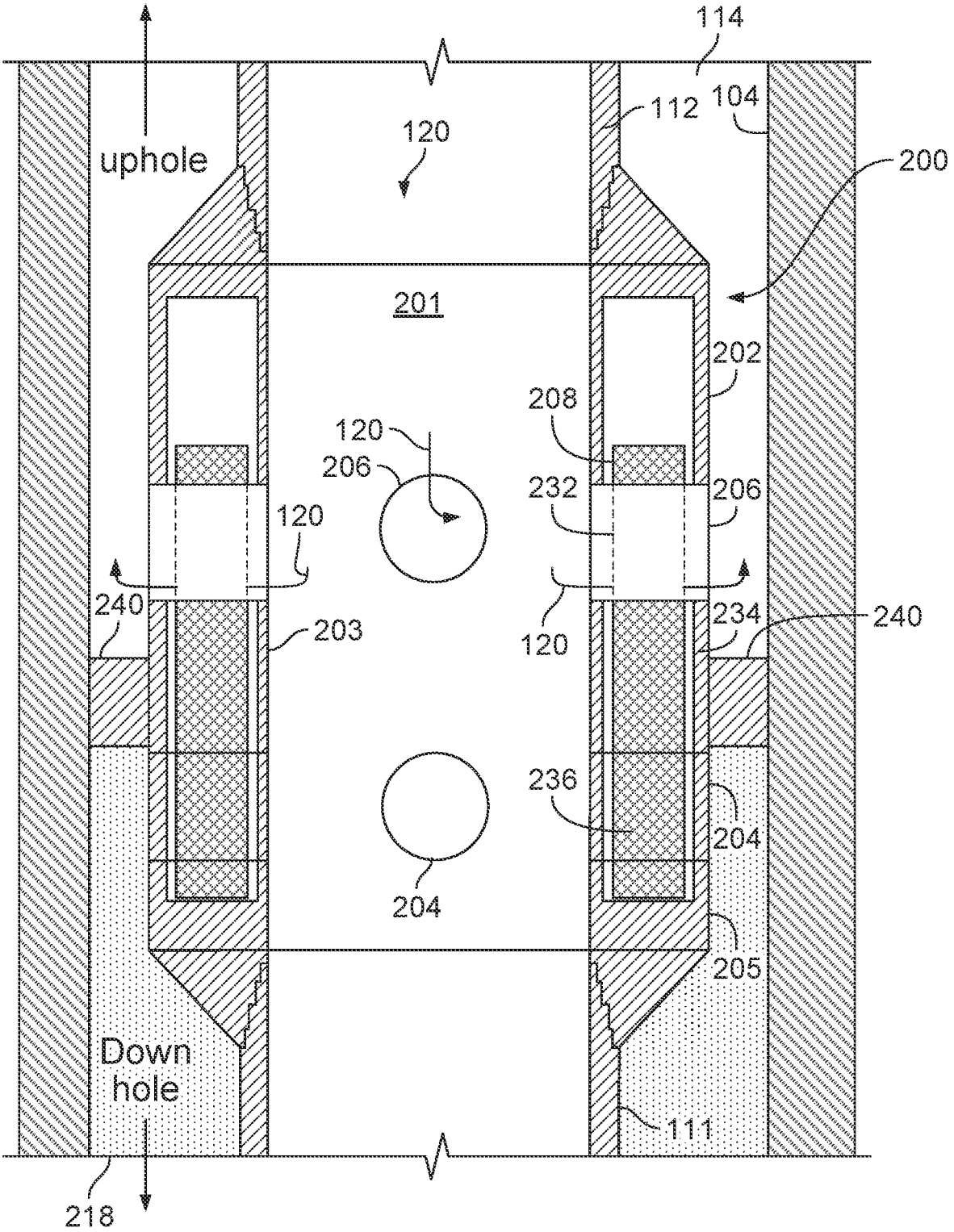
FIG. 2D is a schematic cross-sectional view of the example implementation of the stage cementing tool in a second open position according to the present disclosure.

FIGS. 2A-2D are schematic illustrations of an example implementation of a stage cementing tool 200 for a stage cementing system. For example, in some aspects, the stage cementing tool 200 may be used in the stage cementing system 100 as stage cementing tool 116. FIG. 2A is a schematic illustration of the stage cementing tool 200 positioned in the wellbore 104 uphole of a lost circulation zone 218 and coupled to production casing 111. FIG. 2B is a schematic cross-sectional view of the stage cementing tool positioned in the wellbore 104 uphole of a lost circulation zone 218 and in a closed position. FIG. 2C is a schematic cross-sectional view of the stage cementing tool positioned in the wellbore 104 uphole of a lost circulation zone 218 and in a first open position. FIG. 2D is a schematic cross-sectional view of the stage cementing tool 200 positioned in the wellbore 104 uphole of a lost circulation zone 218 and in a second open position.

The illustrated implementation of the stage cementing tool 200 includes a housing 202 that couples to the casing 111. In some implementations, the housing 202 is configured to couple to casing joints 112 (at a top, or uphole, end of the tool 200 and at a bottom, or downhole, end of the tool 200). As shown in FIGS. 2B-2D, an inner radial surface 203 of the housing 202 defines a central bore 201 that extends through the stage cementing tool 200, and is aligned with the central bore of the casing 111 as illustrated. An outer radial surface 205 of the housing 202 of the stage cementing tool 200 is positioned, when the stage cementing tool is coupled to the casing 111, in the annulus 114 of the wellbore 104. In some implementations, the outer radial surface 204 of the housing 202 of the stage cementing tool 200 is positioned, when the stage cementing tool is coupled to the casing 111 in the annulus 114 uphole of a lost circulation zone 218 of the wellbore.

The illustrated implementation of the stage cementing tool includes multiple ports 204, 206 that extend through the housing 202 between the inner radial surface 203 and the outer radial surface 205. The stage cementing tool 200 includes a first plurality of ports 204, and a second plurality of ports 206 located uphole of the first plurality of ports 204. In the example implementations, the first plurality of ports 204 and the second plurality of ports 206 each include four ports 204, 206 that are radially arranged at 90° intervals around the housing 202. Each port 204, 206 may provide a fluid pathway (closeable) between the central bore 201 and the annulus 114. In alternative implementations, there may be more or fewer ports 204, 206, and each port 204, 206 may have a circular or non-circular cross section. In some implementations, the ports 204, 206 may be rupture-type ports, hydraulic activation type ports, mechanical activation type ports, or a combination thereof.

As depicted in FIGS. 2B-2D, the stage cementing tool 200 includes a seal 210 that covers and fluidly seals the first plurality of ports 204. In some implementations, the seal 210 is a rupture disc. In some examples, the seal 210 is configured to fail when exposed to pressure at or greater than a threshold pressure. In some implementations, the stage cementing tool includes a second seal that fluidly seals the second plurality of ports 206. In some implementations, the pressure at which seal sealing the second plurality of ports 206 fails is greater than the pressure at which the seal 210 fails.

As illustrated, the stage cementing tool 200 also includes a sleeve 208 that is configured to move within a cavity 234 of the housing to block (or unblock) the ports 204, 206. As shown, the sleeve 208 includes a bore 232 therethrough, as well as a block 236 (for example, a solid portion) that is downhole of the bore 232.

As depicted in FIGS. 2B-2D, the stage cementing tool 200 includes an expandable element 240 coupled to the housing 202 of the tool 200 between the first plurality of ports 204 and the second plurality of ports 206. In some implementations, the expandable element 240 is a packer device and expansion of the expandable element 240 hydrostatically isolates the portion of the central bore 201 above the expandable element 240 from the portion of the central bore 201 below the expandable element 240. In some examples, the expandable element 240 is at least one of an inflatable packer, a mechanical packer, or a swellable packer. In some implementations, the expandable element 240 is a metal expanding packer.

FIG. 2B depicts the stage cementing in a closed position. As illustrated, in the closed position, the first plurality of ports 204 are covered by seal 210, which creates a fluid seal between the seal 210 and the ports 204. The sleeve 208 is in a first position within the cavity 234 such that the bore 232 of the sleeve 208 is disposed uphole of both the first plurality of ports 204 and the second plurality of ports 206 and the block 236 of the sleeve 208 is aligned with the second plurality of ports 206. In some implementations, the block 236 of sleeve 208 prevents communication between the bore 201 and the annulus 114 through the ports 206 and fluidly seals the ports 206 when the sleeve 208 is in the first position. In the closed position depicted in FIG. 2B, the expandable element 240 is in an unexpanded state and allows for fluid to pass between the portion of the annulus 114 above the expandable element 240 and the portion of the annulus 114 below the expandable element 240.

In the example operation to activate the stage cementing tool 200 into a first open position, as shown in FIG. 2C, the expandable element 240 is activated to expand and fluidly isolate the portion of the annulus 114 above the expandable element 240 from the portion of the annulus 114 below the expandable element 240. In some implementations, activation of the expandable element 240 involves mechanical expansion of the expandable element. In some examples, activation of the expandable element 240 involves inflation of the expandable element 240. In some implementations, activation of the expandable element 240 includes receiving a first pressurized fluid is from a central bore of the casing 111 to the central bore 201 of the stage cementing tool 200, and the expandable element 240 expands in response to the first pressure received by the central bore 201 of the stage cementing tool 200. In some examples, the expandable element 240 may be activated and expanded using mechanical or hydraulic components. For example, the expandable element may be activated and expanded in response to shifting sleeve 208 of the stage cementing tool 200. In some examples, the expandable element 240 is expanded using mechanical shifting tools conveyed on a wireline or drill-string. In some implementations, the expandable element 240 may be expanded by conveying metal or plastic spherical objects through the central bore 201. In some examples, the expandable element 240 is activated and expanded by a wiper plug (such as wiper plug 306) being communicated through the central bore 201 of the tool. In some implementations, the expandable element 240 can be activated and expanded using shifting darts.

In some examples, after the expandable element 240 is activated and expanded, a second pressurized fluid is received from a central bore of the casing 111 to the central bore 201 of the stage cementing tool 200. The second fluidized pressure received by the central bore 201 of the casing is equal to or greater than a threshold pressure of the seal 210 sealing the first plurality of ports 204. In some examples, the second fluidized pressure is greater than the first fluidized pressure. In response to the second pressure received by the central bore 201 of the casing, the seal 210 ruptures, which exposes the first plurality of ports 204 such that the first plurality of ports 204 fluidly connect the central bore 201 with the annulus 114, as depicted in FIG. 2C. In some implementations, the pressurized fluid is a flow of cement 120. In some examples, the first plurality of ports 204 is mechanically or hydraulically opened to fluidly connect the central bore 201 of the stage cementing tool 200 with the annulus 114. For example, the first plurality of ports 204 may be opened in response to shifting sleeve 208 of the stage cementing tool 200

Upon opening the first plurality of ports 204, a flow of cement is circulated from a through the central bore 201 of the stage cementing tool 200 to the first plurality of ports 204. In some implementations, expansion of the expandable element 240 fluidly isolates the portion of the annulus 114 above the expandable element 240 from the portion of the annulus 114 below the expandable element 240. The cement 120 is circulated through the first plurality of ports 204 to the portion of the annulus 114 between the expandable element 240 and lost circulation zone 218. In some examples, the pressure within the central bore of the casing 111 below the expandable element 240 is higher than the pressure in the annulus 114, and the difference in pressure drives the cement out the first plurality of ports 204 and into the annulus 114. In the example illustration, the stage cementing tool is positioned in the wellbore 104 uphole of a lost circulation zone 218, and the flow of cement is circulated through the first plurality of ports 204 to a portion of the annulus 114 downhole between the expandable element 240 and the top (for example, uphole side) of the lost circulation zone 218, as depicted in FIGS. 2C and 2D.

In the example operation to activate the stage cementing tool 200 into a second open position, as shown in FIG. 2D, first, the sleeve 208 is from a first position (as depicted in FIGS. 2B and 2C) to a second position, as depicted in FIG. 2D. As illustrated, in the second position, the block 236 of the sleeve 208 is aligned with the first plurality of ports 204. The alignment between the block 236 of the sleeve 208 and the first plurality of ports 204 fluidly seals the first plurality of ports 204 and disconnects the central bore 201 from the annulus 114 through the first plurality of ports 204. In some implementations, moving the sleeve 208 from the first to the second position depicted in opens the second plurality of ports, as illustrated in FIG. 2D. For example, as the sleeve 208 travels downhole in the cavity 234, the block 236 of the sleeve 208 misaligns with the second plurality of ports 206 and the bore 232 of the sleeve aligns with the second plurality of ports 206, resulting in communication between the central bore 201 of the stage cementing tool 200 and the annulus 114 through the open second plurality of ports 206.

In some implementations, a seal covers and fluidly seals the second plurality of ports 206, and, in order to open the ports, a fluidized pressure greater than the threshold pressure of the seal is provided to the central bore 201 of the housing. In response to the pressure received by the central bore 201, the seal fluidly sealing the second plurality of ports 206 ruptures, which fluidly connects the central bore 201 with the annulus 114 through the second plurality of ports 206. In some implementations, the pressurized fluid is a flow of cement 120. In some examples, the second plurality of ports 206 is mechanically or hydraulically opened to fluidly connect the central bore 201 of the stage cementing tool 200 with the annulus 114.

Once the second plurality of ports 206 are opened, a flow of cement 120 is circulated from the terranean surface through the central bore 201 and through the second plurality of ports 206 to the annulus 114. In some examples, the pressure generated by the flow of cement in the central bore 201 above the expandable element 240 is higher than the pressure in the annulus 114, and the difference in pressure between the central bore 201 and annulus 114 drives the cement through the casing 111, out the second plurality of ports 206 and into the annulus 114. In the example illustration, the flow of cement is circulated through the second plurality of ports 206 and is displaced to a portion of the annulus 114 uphole of the stage cementing tool 200, as depicted in FIG. 2D.

Figure 3:
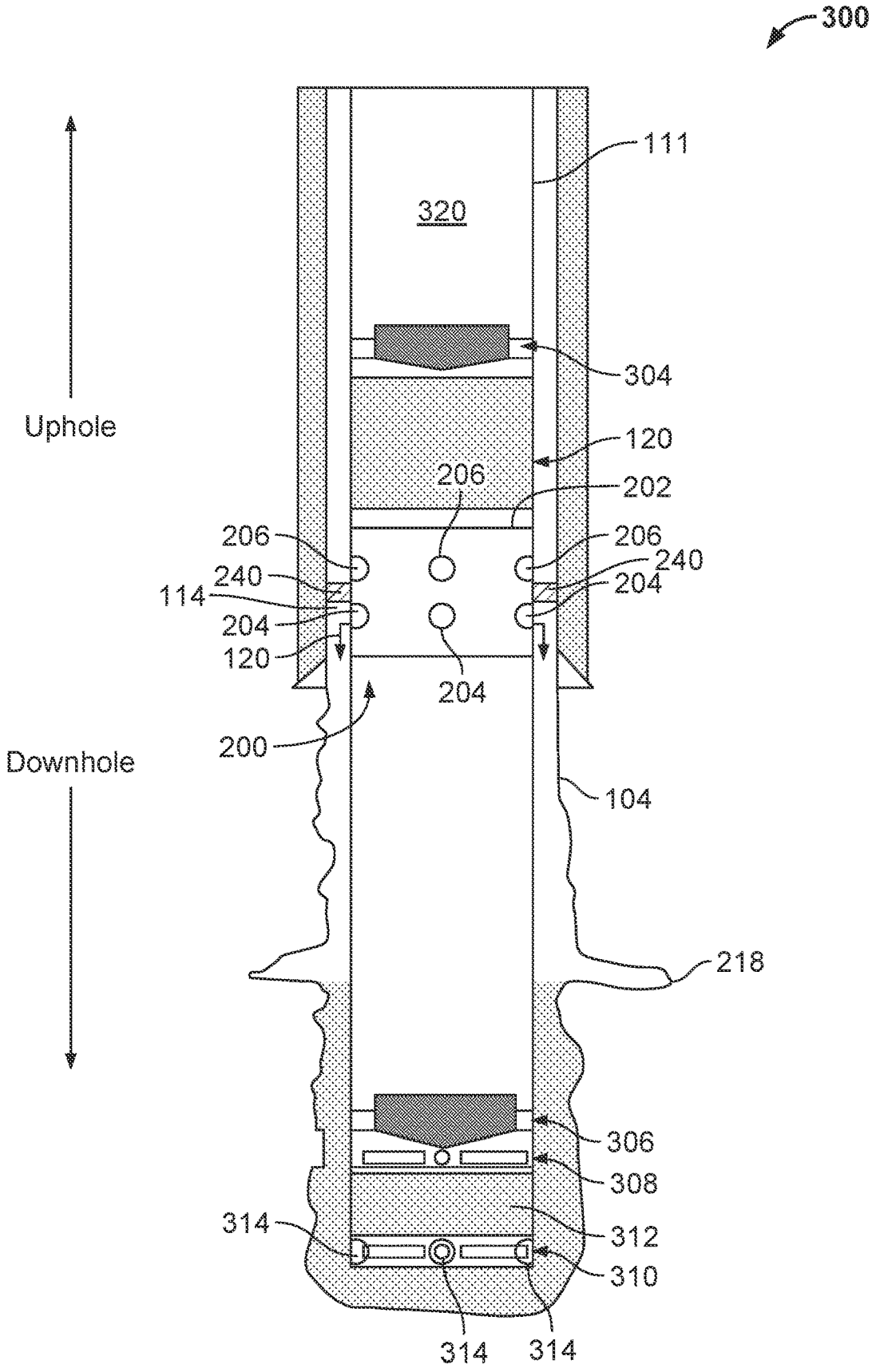
FIG. 3 is a schematic illustration of an example implementation of a stage cementing system according the present disclosure.

FIG. 3 is a schematic illustration of an example implementation of a stage cementing system 300. The system includes a casing 111 disposed within a wellbore 104, a stage cementing tool 200 coupled to the casing 111, and one or more wiper plugs 304, 306. The casing 111 includes a central bore 320 that extends the length of the casing 111.

As illustrated, the stage cementing tool 200 includes a housing 202 with a central bore therethrough, a first plurality of ports 204, a second plurality of ports 206, and an expandable element 240. The ports 204, 206 are arranged on the radial surface of the housing 202 of the stage cementing tool 200, with the second plurality of 206 being oriented uphole from the first plurality of ports 204. The expandable element 240 is coupled to the housing 202 between the first plurality of ports 204 and the second plurality of ports 206, and expansion of the expandable element 240 fluidly isolates the portion of the annulus 114 above the expandable element 240 from the portion of the annulus 114 below the expandable element 240.

In some implementations, the system 300 includes a float collar 308 and a float shoe 310 configured to pump a preliminary flow of cement 312 through a plurality of distal ports 314. The distal ports 314 are arranged on the radial surface of the casing 111 downhole from the stage cementing tool 200. In some implementations, the plurality of distal ports 314 are arranged on the radial surface of a stage cementing tool (for example, stage cementing tool 116) coupled to casing 111 downhole from the stage cementing tool 200. In some implementations, one or more openings of the distal ports 314 are oriented in a downhole direction when the casing 111 is positioned in the wellbore 104.

As illustrated in FIG. 3, positioning the casing 111 in the wellbore 104 includes positioning the casing 111 such that the plurality of distal ports 314 are in fluid communication with a portion of the annulus 114 downhole of a lost circulation zone 218 of the wellbore 104. As illustrated in FIG. 3, positioning the casing 111 in the wellbore 104 also includes positioning the stage cementing tool 200 uphole of the lost circulation zone 218 of the wellbore 104.

In some implementations, after positioning the casing 111 in the wellbore 104, a flow of cement 312 is circulated through a central bore 320 of the casing and through the plurality of distal ports 314 to a portion of the annulus 114 downhole of the lost circulation zone 218. In some implementations, the flow of cement 312 is circulated through the casing 111 to the distal ports 314 using the float collar 308 and the float shoe 310. As illustrated, a wiper plug 306 is communicated through the central bore 320 of the casing 111 behind the flow of cement 312 to circulate the flow of cement 312 through the plurality of distal ports 314 to the portion of the annulus 114 downhole of the lost circulation zone 218. Communicating the wiper plug 306 through the casing 111 pressurizes the flow of cement 312, which circulates the cement 312 downhole through the central bore 320 of the casing 111 and through the plurality of distal ports 314. As depicted in FIG. 3, the wiper plug 306 continues to move axially the central bore 320 of the casing 111 until the wiper plug 306 mates with the float collar 308 at the downhole portion of the casing 111. In some implementations, the pressure required to circulate the flow of cement 312 through the plurality of distal ports 314 is less than the threshold pressure of a seal fluidly sealing the first plurality of ports 204 or the stage cementing tool 200 (for example, seal 210 of FIGS. 2B-2D).

In some examples, the expandable element 240 is activated to expand and fluidly isolate the portion of the annulus 114 above the expandable element 240 from the portion of the annulus below the expandable element 240. In some implementations, a fluidized pressure is provided to the central bore 320 of the casing 111 to activate the expandable element 240 of the stage cementing tool 200. In some implementations, the pressure is provided by a flow of pressurized cement 120 provided to the central bore 320 above the mated wiper plug 306. For example, the mated wiper plug 306 prevents the cement 120 from flowing out of the distal ports 314, which generates a pressure within the central bore 320 as cement 120 is provided to the central bore 320.

Once activated, the expandable element 240 fluidly seals the portion of the annulus 114 downhole of the expandable element 240 from the portion of the annulus 114 uphole of the expandable element 240. As depicted in FIG. 3, the expandable element 240 is coupled to the stage cementing tool 200 between the first plurality of ports 204 of the tool 200 and the second plurality of ports 206 of the tool. In some implementations, the expandable element 240 is a packer. In some examples, the expandable element 240 may be activated and expanded using mechanical or hydraulic components. For example, the expandable element may be activated and expanded in response to shifting a sleeve of the stage cementing tool 200 (such as sleeve 208 of FIGS. 2B-2D).

After activating and expanding the expandable element 240, the first plurality of ports 204 of the stage cementing tool 200 are opened to fluidly connect a central bore of the stage cementing tool 200 with the annulus 114 of the wellbore 104. As previously discussed, in some implementations, the first plurality of ports 204 are opened in response to a pressurized fluid provided by the central bore 320 having a pressure greater than a threshold pressure of a seal sealing the ports 204 (for example, seal 210 of FIGS.

2B-2D), such that the seal ruptures in response to the pressure. In some implementations, the pressure is provided by a flow of pressurized cement 120 provided to the central bore 320 above the mated wiper plug 306. In some examples, the pressurized fluid used to set the expandable element 240 also ruptures the seal sealing the first plurality of ports 204 and fluidly connects the central bore of the stage cementing tool and the annulus 114 through the first plurality of ports 204. As previously discussed, in some implementations, the first plurality of ports 204 are opened using mechanical or hydraulic components. For example, the first plurality of ports 204 may be opened in response to shifting a sleeve of the stage cementing tool 200 (such as sleeve 208 of FIGS. 2B-2D).

Once the first plurality of ports 204 are open to fluidly connect a central bore of the stage cementing tool 200 with the annulus 114, the cement 120 contained within the central bore 320 between the mated wiper plug 306 and the first plurality of ports 204 is circulated through the central bore 320 of the casing 111 and the central bore of the stage cementing tool 200 to the first plurality of ports 204. The cement is then circulated through the first plurality of ports 204 to the annulus 114. In some examples, the pressure within the central bore 320 of the casing 111 below the expandable element 240 is higher than the pressure in the annulus 114, and the difference in pressure drives the cement uphole through the casing 111, out the first plurality of ports 204 and into the annulus 114. As previously discussed, and as illustrated in FIG. 3, the flow of cement 120 circulated through the first plurality of ports 204 may be provided to a portion of the annulus 114 located between the expandable element 240 and the top (for example, uphole side) of the lost circulation zone 218. Providing stage cement to the portion of the annulus 114 between the bottom of the stage cementing tool 200 and the top of the lost circulation zone 218 provides improve mechanical stability of the casing 111 and reduces the risk of corrosion of the casing 111.

To complete the first stage cementing, a sleeve of the stage cementing tool 200 (for example, sleeve 208 of FIGS. 2B-2D) is moved from a first position on the housing 202 of the stage cementing tool 200 to a second position on the housing 202 of the stage cementing tool 200 to fluidly disconnect the central bore of the stage cementing tool 200 and the annulus 114 through the first plurality of ports 204. As discussed in reference to FIGS. 2B-2D, the sleeve is moved within the housing 202 such that a solid portion of the sleeve 208 (for example, block 236 of FIGS. 2B-2D) is aligned with and fluidly seals the first plurality of ports 204. In some implementations, an opening through the sleeve (for example, bore 232 of FIGS. 2B-2D) is aligned with second plurality of ports 206 when the sleeve is in the second position. In some examples, the sleeve is moved in an axially direction along the housing 202 of the stage cementing tool 200 from a first position to a second position located downhole of the first position. In some implementations, the sleeve is moved from a first position to a second position by rotation of the sleeve within the housing.

In some implementations, a wiper plug 304 is communicated through the central bore 320 of the casing 111 and the central bore of the stage cementing tool 200 to move the sleeve 208 from the first position to the second position. For example, as the wiper plug 304 is communicated through the central bore of the stage cementing tool 200, the wiper plug 304 physically engages the sleeve of the stage cementing tool 200 and causes the sleeve to move axially along the housing 202 of the stage cementing tool 200 in a downhole direction until the sleeve reaches the second position. In some implementations, the first plurality of ports 204 are closed to fluidly disconnect the central bore of the stage cementing tool 200 and the annulus 114 through the first plurality of ports 204 in response to communication of the wiper plug 304 through the central bore of the stage cementing tool 200.

The second plurality of ports 206 are opened to fluidly connect the central bore 201 of the stage cementing tool 200 and the annulus 114. As previously discussed, in some implementations, alignment between a bore of the sleeve (for example, bore 232 of FIGS. 2B-2C) and the second plurality of ports 206 when the sleeve is in a second position opens the second plurality of ports 206 and creates a fluid connection between the central bore of the stage cementing tool 200 and the annulus 114 through the second plurality of ports 206. In some implementations, the second plurality of ports are opened in response to a fluid pressure received from the central bore 320 of the casing 111 greater than a threshold pressure of a seal fluidly sealing the second plurality of ports 206, such that seal ruptures and exposes ports 206 to the central bore of the stage cementing tool 200. In some implementations, the second plurality of ports 206 may be opened using mechanical or hydraulic components.

A flow of cement 120 is circulated through the central bore 320 of the casing 111 and the central bore of the stage cementing tool 200 to the second plurality of ports 206. In some examples, the flow of cement 120 is provided to the central bore 320 of the casing 111 from the terranean surface. The flow of cement 120 is circulated through the central bore 320 of the casing 111 and through the second plurality of ports 206 to the annulus 114. As depicted in FIG. 2D, in some implementations, the flow of cement 120 circulated through the second plurality of ports 206 is provided to a portion of the annulus 114 uphole of the stage cementing tool 200. In some examples, the pressure generated by the flow of cement in the central bore 320 above the expandable element 240 is higher than the pressure in the annulus 114, and the difference in pressure between the central bore 320 and annulus 114 drives the cement through the casing 111, out the second plurality of ports 206, and into the annulus 114.

In some implementations, cement provided to the portion of the annulus 114 uphole of the stage cementing tool 200 is referred to as "second stage cement." In some implementations, a wiper plug (not pictured) may be communicated through the central bore 320 of the casing 111 and the central bore of the stage cementing tool 200 to close the second plurality of ports 206 and disconnect the central bore of the stage cementing tool 200 and the annulus 114 through the second plurality of ports 206. In some implementations, a free falling dart is communicated through the central bore 320 of the casing and the central bore of the stage cementing tool 200 to close the second plurality of ports 206 and disconnect the central bore of the stage cementing tool 200 and the annulus 114 through the second plurality of ports 206. In some examples, the second plurality of ports 206 are closed by shifting a sleeve of the stage cementing tool 200 (such as sleeve 208 of FIGS. 2B-2D) to cover and seal the second plurality of ports 206.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A stage cementing method, comprising:

positioning a casing comprising a stage cementing tool in a wellbore;

expanding an expandable element coupled to a housing of the stage cementing tool between a first plurality of ports arranged on a radial surface of the housing of the stage cementing tool and a second plurality of ports arranged on the radial surface of the housing uphole of the first plurality of ports;

opening the first plurality of ports to connect a central bore of the stage cementing tool to an annulus of the wellbore;

circulating a first flow of cement through the first plurality of ports to a first portion of the annulus of the wellbore located adjacent the radial surface of the casing between a bottom of the stage cementing tool and a top of a lost circulation zone of the wellbore;

moving a sleeve of the stage cementing tool from a first position on the housing of the stage cementing tool to a second position on the housing of the stage cementing tool and thereby fluidly disconnecting the central bore of the stage cementing tool and the annulus through the first plurality of ports and fluidly connecting the central bore of the stage cementing tool and the annulus through the second plurality of ports; and circulating a second flow of cement through the second plurality of ports to a second portion of the annulus of the wellbore adjacent the radial surface uphole of the stage cementing tool.

2. The stage cementing method of claim 1, wherein positioning the casing comprises lowering the casing in the wellbore to position the first plurality of ports uphole of the lost circulation zone of the wellbore.

3. The stage cementing method of claim 1, wherein expanding the expandable element comprises receiving a fluid have a first fluid pressure greater than a first threshold pressure from the central bore of the casing.

4. The stage cementing method of claim 1, wherein opening the first plurality of ports comprises receiving a fluid having a second fluid pressure greater than a second threshold pressure from the central bore of the casing.

5. The stage cementing method of claim 4, wherein the second fluid pressure ruptures a seal of the stage cementing tool that fluidly seals the first plurality of ports.

6. The stage cementing method of claim 1, further comprising:

communicating a wiper plug through the central bore of the casing; and based on communicating the wiper plug through the central bore of the casing, moving the sleeve of the stage cementing tool from the first position on the housing of the stage cementing tool to the second position on the housing of the stage cementing tool.

7. The stage cementing method of claim 1, wherein moving the sleeve of the stage cementing from the first position on the housing of the stage cementing tool to the second position on the housing of the stage cementing tool comprises shifting the sleeve axially within the housing.

8. The stage cementing method of claim 1, wherein moving the sleeve of the stage cementing from the first position on the housing of the stage cementing tool to the second position on the housing of the stage cementing tool comprises rotating the sleeve within the housing.

9. The stage cementing method of claim 1, further comprising:

circulating a preliminary flow of cement through the central bore of the casing and through a plurality of distal ports downhole from the stage cementing tool to a portion of the annulus below a loss circulation zone; and communicating a wiper plug through the central bore of the wellbore to a distal portion of the casing, wherein the wiper plug couples to a float collar to disconnect the central bore of the casing and the annulus through the distal ports.

* * * * *